United States Patent [19]

Schwing et al.

[11] Patent Number: 5,022,934

[45] Date of Patent: Jun. 11, 1991

[54] HEAT TREATING A METALLIC WORKPIECE IN A FLUIDIZED BED

[75] Inventors: Ewald Schwing, Neukirchen-Vluyn; Peter Sommer; Horst Uhrner, both of Issum, all of Fed. Rep. of Germany

[73] Assignees: Ewald Schwing, Neukirchen-Vlyn; Horst Uhrner, Issum, both of Fed. Rep. of Germany

[21] Appl. No.: 465,736

[22] Filed: Jan. 16, 1990

Related U.S. Application Data

[63] Continuation-in-part of Ser. No. 405,412, Sep. 11, 1989, abandoned, continuation of Ser. No. 167,564, Mar. 14, 1988, abandoned.

[30] Foreign Application Priority Data

May 30, 1987 [DE] Fed. Rep. of Germany ..... 3718240

[51] Int. Cl.[5] ..... C21D 1/53

[52] U.S. Cl. ..... 148/16.5; 148/16.6

[58] Field of Search ..... 148/16, 16.5, 16.6

[56] References Cited

U.S. PATENT DOCUMENTS

| | | | |
|---|---|---|---|
| 4,461,656 | 7/1984 | Ross | 148/16.6 |
| 4,519,853 | 5/1985 | Kostelitz et al. | 148/16.5 |
| 4,547,228 | 10/1985 | Girrell et al. | 148/16 |
| 4,881,983 | 11/1989 | Smith et al. | 148/16.6 |

FOREIGN PATENT DOCUMENTS 3345946 6/1984 Fed. Rep. of Germany .

OTHER PUBLICATIONS

Merkblatt 447, "Beratungsstelle für Stahlverwendung," 1983 edition.

Fluidized-bed heat treatment, Von. P. Sommer, published in Warme Gas International (6 pages), vol. 33 (1984).

Publication by Beratungsstelle fur Stahlverwendung, 2nd edition 1983 pp. 15–30.

*Primary Examiner*—Melvyn J. Andrews
*Assistant Examiner*—George Wyszomierski
*Attorney, Agent, or Firm*—Herbert Dubno; Andrew Wilford

[57] ABSTRACT

A process for heat treating a metallic workpiece comprises the steps of first heating the metallic workpiece in a gas stream fluidized bed made from a plurality of refractory particles for 2 min to 10 min under an inert-gas atmosphere to a treatment temperature of from about 500° to 650° C. Then the heated workpiece is preoxidized with an oxidizing gas stream in the fluidized bed. Finally the heated workpiece is nitrocarburized by contacting it for between 0.5 h and 10 h in the fluidized bed with a gas mixture composed of nitrogen, ammonia, and a carbon-rich gas. The composition of the gas mixture is varied during the nitrocarburizing step from a starting composition of about 75% to 40% by volume of ammonia and from about 20% to 55% by volume nitrogen with the balance being propane or natural gas by reducing the ammonia partial volume in a series of steps at intervals from 10 min to 60 min and increasing the nitrogen partial volume component complementarily such that the partial volume component of the carbon-rich gas is kept constant during the carburization to an ending composition of from about 10% to 30% by volume ammonia. In this manner the workpiece surface is left substantially free of pores.

3 Claims, 1 Drawing Sheet

HEAT TREATING A METALLIC WORKPIECE IN A FLUIDIZED BED

CROSS REFERENCE TO RELATED APPLICATIONS

This application is a continuation-in-part of copending patent application No. 07/405,412 now abandoned filed Sept. 11, 1989 as a file-wrapper continuation of now abandoned patent application No. 07/167,564 itself filed Mar. 14, 1988.

FIELD OF THE INVENTION

The present invention relates to a method of heat-treating a metallic workpiece in a fluidized bed. More particularly this invention concerns nitrocarburizing a ferrometallic workpiece.

BACKGROUND OF THE INVENTION

It is known to heat treat a metallic workpiece in a fluidized bed of fire-resistant refractory particles under an inert gas atmosphere at a treatment temperature of 500° to 650° C. The heated workpiece is contacted in the fluidized bed with a gas mixture composed of nitrogen, ammonia, and a carbon-rich gas to nitrocarburize it.

The temperature of the gas used in this heat treatment determines the oven atmosphere. Such fluidized-bed heat treatment is characterized by good heat transfer so that the treatment time is short. In addition in such a system the gas atmosphere can be modified in an extremely short time by changing its composition, as the large volume of gas that must pass through the bed to fluidize it ensures that the changes per unit of time are large so that any change in the composition of the fluidizing gas is immediately apparent. Thus the inert-gas atmosphere used during the heating and the thermochemical atmosphere during the actual heat treatment can be clearly separated (*Gas Heat International* 33, pp. 290 to 295 (1984) [*Gaswarme International* 33 (1984), S. 290 to 295]).

Such a process is typically used for nitrocarburizing, which is a gas nitriding process associated with a carbon uptake. Thus a surface or compound layer forms on the workpiece which can have up to 10% by weight nitrogen and up to 2% by weight carbon and a minimum thickness of 5 micron to 15 micron. The compound layer formed by nitrocarburizing is characterized by an improved wear resistance relative to the base material of the workpiece and an improved corrosion resistance.

U.S. Pat. Nos. 4,512,821 and 4,524,957 describe a process wherein the gas composition remains constant during the nitrocarburization. Nothing is done to the workpiece in the fluidized bed before the nitrocarburizing to pretreat the workpiece. As a result the surface layer formed by the nitrocarburizing is porous to a considerable extent at least at the outer surface and to a lesser extent throughout the cross section of the surface layer. The pores reduce the hardness and the wear resistance of the surface layer formed by nitrocarburizing.

OBJECTS OF THE INVENTION

It is an object of our invention to provide an improved process for heat treating a metallic workpiece in a gas stream fluidized bed which will overcome these drawbacks.

It is also an object of our invention to provide an improved process for nitrocarburizing a metallic workpiece in a gas stream fluidized bed in which pore formation is minimized and because of that the wear resistance of the surface layer is improved.

SUMMARY OF THE INVENTION

A process for heat treating a metallic workpiece comprises the steps of first heating the metallic workpiece in a gas stream fluidized bed made from a plurality of refractory particles for 2 min to 10 min under an inert-gas atmosphere to a treatment temperature of from about 500° to 650° C. Then the heated workpiece is preoxidized with an oxidizing gas stream in the fluidized bed. Finally the heated workpiece is nitro-carburized by contacting it for between 0.5 h and 10 h in the fluidized bed with a gas mixture composed of nitrogen, ammonia, and a carbon-rich gas, here propane or natural gas. According to the invention the composition of the gas mixture is varied during the nitrocarburizing step from a starting composition of about 75% to 40% by volume of ammonia and from about 20% to 55% by volume nitrogen with the balance being propane or natural gas by reducing the ammonia partial volume in a series of steps at intervals from 10 min to 60 min and increasing the nitrogen partial volume component complementarily such that the partial volume component of the carbon-rich gas is kept constant during the carburization to an ending composition of from about 10% to 30% by volume ammonia. In this manner the workpiece surface is left substantially free of pores.

It is known from heat treatment in a conventional heat treatment oven that a preoxidation of the workpiece prior to nitrocarburizing improves the nitrogen uptake (see for example *Advisory for Steel Applications*, Pamphlet 447, 1983 Edition [Beratungsstelle für Stahlverwendung, Merkblatt 447, S. Auflage 1983]). Surprisingly the combination of this feature with the stepwise or continuous reduction of the ammonia partial volume component in the gas mixture during the nitrocarburizing performed in the fluidized bed in the process of our invention is characterized by a reduced number of pores and a higher wear resistance on the surface of the workpiece product.

Another advantage of this invention is that ammonia is used very sparingly, thereby substantially reducing the cost of the hardening process.

According to another feature of this invention air is used in the oxidizing gas stream and the oxidizing step takes from 2 min to 10 min. In addition after nitrocarburizing the workpiece is reoxidized with moist air.

DESCRIPTION OF THE DRAWING

The above and other objects, features, and advantages will become more readily apparent from the following, reference being made to the accompanying drawing in which.

EXAMPLE

The invention is applied to a process for heat treatment of a steel workpiece in a fluidized bed made of refractory particles of $Al_2O_3$ fluidized with a stream of gas. The fluidized gas at the same time determines the gas atmosphere. In a first process step the workpiece is heated in the fluidized bed under an inert gas atmosphere to a process temperature of from 500° C. to 650° C. The fluidizing of the refractory particles and the formation of the fluidized bed is effected with nitrogen.

The workpiece heated to the above treatment temperature is subsequently oxidized in the same oven in the fluidized bed with an oxidizing gas flow containing an oxidizing agent. The fluidizing of the refractory particles occurs in this process step with air to which the workpiece is exposed for about 2 min to 10 min. This oxidation is carried out sufficiently long to ensure complete oxidation of the surface but not long enough to promote active burning. In fact at the end of the oxidation step it is within the scope of this invention to flush the furnace with an inert gas like nitrogen to extinguish any further oxidation.

In a third process step the hot workpiece oxidized in the air stream is contacted by a mixed gas flow composed of nitrogen, ammonia and a carbon-rich gas and thus is nitrocarburized in the fluidized bed. During the nitrocarburization the ammonia partial volume composition of the mixed gas flow is reduced in several steps and the nitrogen volume composition is increased complementarily. Thus the nitrogen partial volume component is varied so that the partial volume component of the carbon-rich gas remains constant in the gas mixture during the nitrocarburizing. Advantageously according to this example the workpiece is nitrocarburized for about 2h. The mixed gas composition is adjusted during the treatment time according to the following table (all percents by volume):

| Treatment time (min) | Ammonia % | Nitrogen % | Propane % |
|---|---|---|---|
| 0 to 30 | 60 | 35 | 5 |
| 30 to 60 | 50 | 45 | 5 |
| 60 to 90 | 40 | 55 | 5 |
| 90 to 120 | 30 | 65 | 5 |

For improvement of the corrosion resistance the workpiece subjected to nitrocarburizing is later oxidized with fresh moist air.

Figure 1:
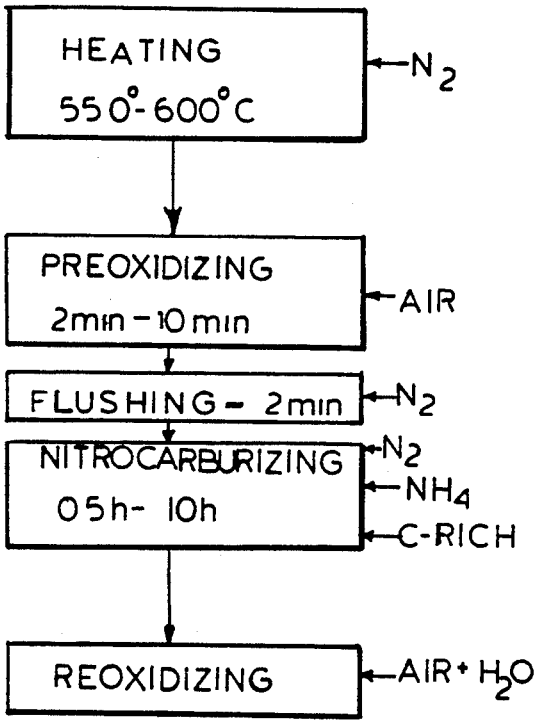
FIG. 1 is a flow chart illustrating the method of this invention.
Figure 2:
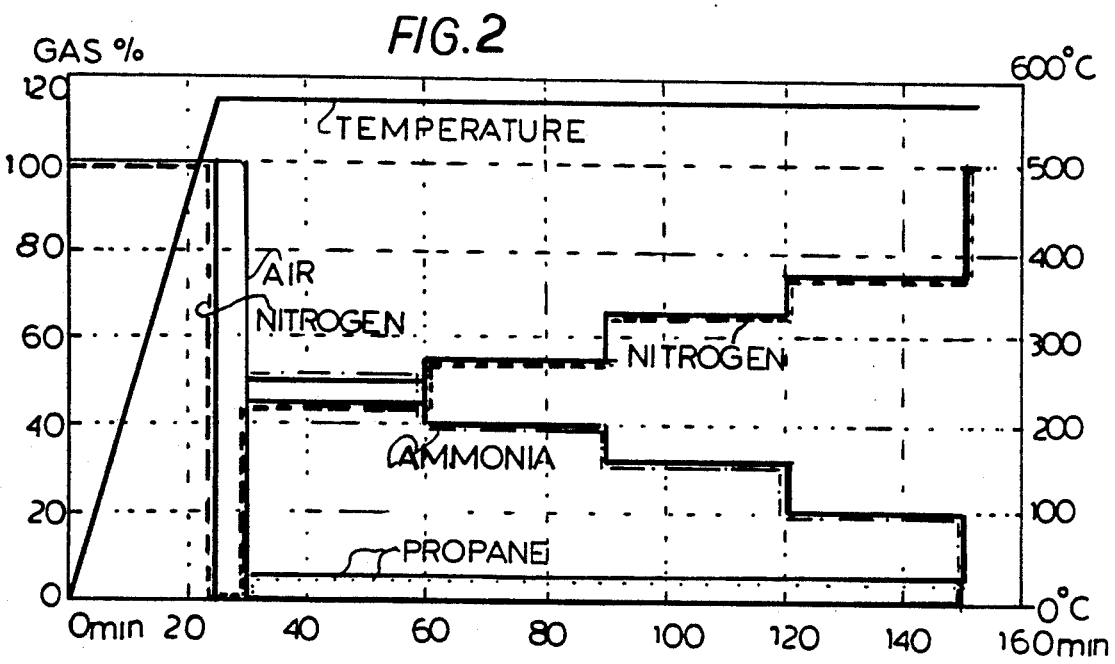
FIG. 2 is a graph illustrating the method of the present invention.

According to this invention the process is carried out in an apparatus having a 350 mm diameter at 570°. The average size of the aluminum-oxide particles is 200 microns and the gas throughflow is 12 $m^2$ /h. FIG. 2 shows how it takes about 25 min for the workpiece to be heated to the desired temperature in a pure-nitrogen atmosphere. Then the atmosphere is changed to air (about 21% $O_2$) for 5 min to preoxidize the workpiece.

Subsequent to preoxidation the atmosphere is changed to 45% by volume $N_2$, 50% $NH_4$, and 5% $C_nH_2N$. The propane content is thereafter kept constant but every 30 min the ammonia partial volume is decreased by 15% and the nitrogen content is complementarily increased by 15% until at a total treatment time of 150 min the process is ended as the nitrogen displaces both the propane and the ammonia. The total time for the nitrocarburizing step is therefore 2 h. During the nitrocarburizing step it is possible within the scope of this invention to alternate the throughflow of gas between the above-described 12 $m^2$/h high rate to a low rate that is at least 10% and at most 50% of this rate, typically about one-third. The alternations are 2 min to 15 min apart, typically about 8 min at each rate before alternating to the other rate.

Whereas the prior-art systems typically produce a treated surface layer some 10 micron to 15 micron thick comprised at least 50% of a porous foam, the system of this invention produces a surface layer with virtually no porosity. This frees the consumer from the work of finishing-off the workpiece by removing the porous part of the surface layer.

We claim:

1. A process for heat treating a metallic workpiece comprising the steps of:
   a) heating the metallic workpiece in a gas stream fluidized bed made from a plurality of refractory particles for 2 min to 10 min under an inert-gas atmosphere to a treatment temperature of from about 500° to 560° C.;
   b) thereafter oxidizing the heated workpiece with an oxidizing gas stream in the fluidized bed;
   c) thereafter flushing the fluidized bed with an inert gas and thereby terminating any oxidation therein;
   d) thereafter nitrocarburizing the oxidized and heated workpiece by contacting it for between 0.5 h and 10 h in the fluidized bed with a gas mixture composed of nitrogen, ammonia, and a carbon-rich gas; and
   e) varying the composition of the gas mixture during step d) from a starting composition of about 75% to 40% by volume of ammonia and from about 20% to 55% by volume nitrogen with the balance being propane or natural gas by reducting the ammonia partial volume in a series of steps at intervals from 10 min top 60 min and increasing the nitrogen partial volume component complementarily such that the partial volume component of the carbon-rich gas is kept constant during step d) to an ending composition of from about 10% to 30% by volume ammonia, whereby the workpiece surface is left substantially free of pores.

2. The improvement defined in claim 1 wherein air is used in the oxidizing gas stream and step b) takes from 2 min to 10 min.

3. The improvement defined in claim 1 wherein after nitrocarburizing the workpiece is oxidized with moist air.

* * * * *